US008272444B2

(12) United States Patent
Baugh

(10) Patent No.: US 8,272,444 B2
(45) Date of Patent: Sep. 25, 2012

(54) METHOD OF TESTING A DRILLING RISER CONNECTION

(76) Inventor: Benton Frederick Baugh, Houston, TX (US)

( * ) Notice: Subject to any disclaimer, the term of this patent is extended or adjusted under 35 U.S.C. 154(b) by 347 days.

(21) Appl. No.: 12/590,508

(22) Filed: Nov. 10, 2009

(65) Prior Publication Data

US 2011/0108280 A1 May 12, 2011

(51) Int. Cl.
*E21B 17/02* (2006.01)
*E21B 33/038* (2006.01)

(52) U.S. Cl. ..... 166/336; 166/338; 166/344; 166/367; 166/250.01; 285/93; 285/96

(58) Field of Classification Search ..... 166/348, 166/336–338, 344, 351, 352, 360, 367, 250.01, 166/378–380, 77.51, 85.1; 405/169, 170, 405/224.2; 285/93, 922, 95, 96; 403/27; 277/317, 320, 322; 73/37, 46
See application file for complete search history.

(56) References Cited

U.S. PATENT DOCUMENTS

| | | | | | |
|---|---|---|---|---|---|
| 2,350,867 | A * | 6/1944 | Bean et al. | 285/96 |
| 2,531,596 | A * | 11/1950 | Allen et al. | 285/96 |
| 2,597,193 | A * | 5/1952 | Shaffer | 73/46 |
| 3,141,685 | A * | 7/1964 | Watts | 285/93 |
| 3,333,870 | A * | 8/1967 | Watkins | 285/18 |
| 3,711,123 | A * | 1/1973 | Arnold | 285/18 |
| 3,719,070 | A * | 3/1973 | Hanes | 73/37 |
| 4,019,371 | A * | 4/1977 | Chaplin et al. | 73/46 |
| RE30,311 | E * | 6/1980 | Chaplin et al. | 73/46 |
| 4,652,022 | A * | 3/1987 | Nichols | 285/92 |
| 5,098,132 | A * | 3/1992 | Burton | 285/18 |
| 5,170,659 | A * | 12/1992 | Kemp | 73/46 |
| 5,634,671 | A * | 6/1997 | Watkins | 285/18 |
| 6,000,278 | A * | 12/1999 | Hystad | 73/46 |
| 6,299,216 | B1 * | 10/2001 | Thompson | 285/93 |
| 6,435,775 | B1 * | 8/2002 | Nish et al. | 405/224.2 |
| 6,595,293 | B2 * | 7/2003 | Carter | 166/345 |
| 6,609,734 | B1 * | 8/2003 | Baugh | 285/322 |
| 6,679,472 | B2 * | 1/2004 | Baugh | 251/62 |
| 6,966,381 | B2 * | 11/2005 | Stjernstrom et al. | 166/337 |
| 7,118,137 | B2 * | 10/2006 | Deremiah | 285/93 |
| 7,344,162 | B2 * | 3/2008 | Van Bilderbeek | 285/95 |
| 7,647,973 | B2 * | 1/2010 | Minassian et al. | 166/338 |
| 7,686,087 | B2 * | 3/2010 | Pallini et al. | 166/367 |
| 7,942,452 | B2 * | 5/2011 | Carns et al. | 285/93 |
| 2006/0117838 | A1 * | 6/2006 | Williams | 73/46 |

OTHER PUBLICATIONS pp. 18-21 from Cameron Loadking 3.5 Riser Service Manual.
Quick Riser Connection ADD p. 69 Offshore Engineer Mag Feb. 2009.

* cited by examiner

*Primary Examiner* — Matthew Buck

(57) ABSTRACT

The method of providing flotation modules on subsea drilling riser joints comprising providing flotation modules as a full circle, installing said flotation modules sequentially onto the end of the central pipe of said drilling riser joints in a desired orientation, providing passageways through said flotation modules which extend from one end of said subsea drilling riser joints to the other end of said drilling riser joints.

11 Claims, 11 Drawing Sheets

METHOD OF TESTING A DRILLING RISER CONNECTION

TECHNICAL FIELD

This invention relates to the general subject of testing of connections between sections of riser pipe for subsea drilling systems.

CROSS-REFERENCE TO RELATED APPLICATIONS

Not applicable.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

The field of this invention is that drilling risers for deep water blowout preventer systems are major pieces of capital equipment landed on the ocean floor in order to provide a conduit for the drill pipe and drilling mud while also providing pressure protection while drilling holes deep into the earth for the production of oil and gas. The typical blowout preventer stacks have an 18¾ inch bore and are usually of 10,000 psi working pressure. The blowout preventer stack assembly weighs in the range of five hundred to eight hundred thousand pounds. It is typically divided into a lower blowout preventer stack and a lower marine riser package.

The lower blowout preventer stack includes a connector for connecting to the wellhead at the bottom on the seafloor and contains several individual ram type blowout preventer assemblies, which will close on various pipe sizes and in some cases, will close on an open hole with what are called blind rams. Characteristically there is an annular preventer at the top, which will close on any pipe size or close on the open hole.

The lower marine riser package typically includes a connector at its base for connecting to the top of the lower blowout preventer stack, it contains a single annular preventer for closing off on any piece of pipe or the open hole, a flex joint, and a connection to a riser pipe which extends to the drilling vessel at the surface.

The purpose of the separation between the lower blowout preventer stack and the lower marine riser package is that the annular blowout preventer on the lower marine riser package is the preferred and most often used pressure control assembly. When it is used and either has a failure or is worn out, it can be released and retrieved to the surface for servicing while the lower blowout preventer stack maintains pressure competency at the wellhead on the ocean floor.

The riser pipe extending to the surface is typically a 21 inch O.D. pipe with a bore larger than the bore of the blowout preventer stack. It is a low pressure pipe and will control the mud flow which is coming from the well up to the rig floor, but will not contain the 10,000-15,000 psi that the blowout preventer stack will contain. Whenever high pressures must be communicated back to the surface for well control procedures, smaller pipes on the outside of the drilling riser, called the choke line and the kill line, provide this function. These will typically have the same working pressure as the blowout preventer stack and rather than have an 18%-20 inch bore, they will have a 3-4 inch bore. There may be additional lines outside the primary pipe for delivering hydraulic fluid for control of the blowout preventer stack or boosting the flow of drilling mud back up through the drilling riser.

For the 50 years in which drilling risers have been utilized, there has been a stepwise evolution of risers generally solving sequential problems by adding one more component each time. That outside or auxiliary lines were added before flotation has meant that inventors using obvious techniques have added half or semi-circular sections of buoyancy to the risers. The half or semi-circular sections have had portions removed to go over clamps to support the outside or auxiliary lines and have been of a relatively weak structural shape. These disadvantages have been accepted as what you have to do to add flotation to the riser joints.

For the 50 years in which drilling risers have been utilized, there has been a continual balance between the number of joint to run before flooding the individual lines for an internal test and the cost of pulling multiple joints of riser if one of the connections leaks. The operations will be faster a higher number of joints are run before testing. The longer it can take to pull joints and determine which is leaking if one leaks.

BRIEF SUMMARY OF THE INVENTION

The object of this invention is to provide a method for testing the multiplicity of hydraulic connections at a drilling riser joint at the time the connection is made up.

A second object of this invention is to test the connections during the same time in which the mechanical connection is being made up.

A third object of this invention is record the pressure decline curve of the test fluid testing the multiplicity of connections.

Another object of the present invention determine a standard pressure decline curve for the testing of the multiplicity of connections.

Another object of the present invention is to compare the difference between the standard pressure decline curve with the current pressure decline to determine acceptability of the current pressure decline curve.

DETAILED DESCRIPTION OF THE INVENTION

Figure 1:
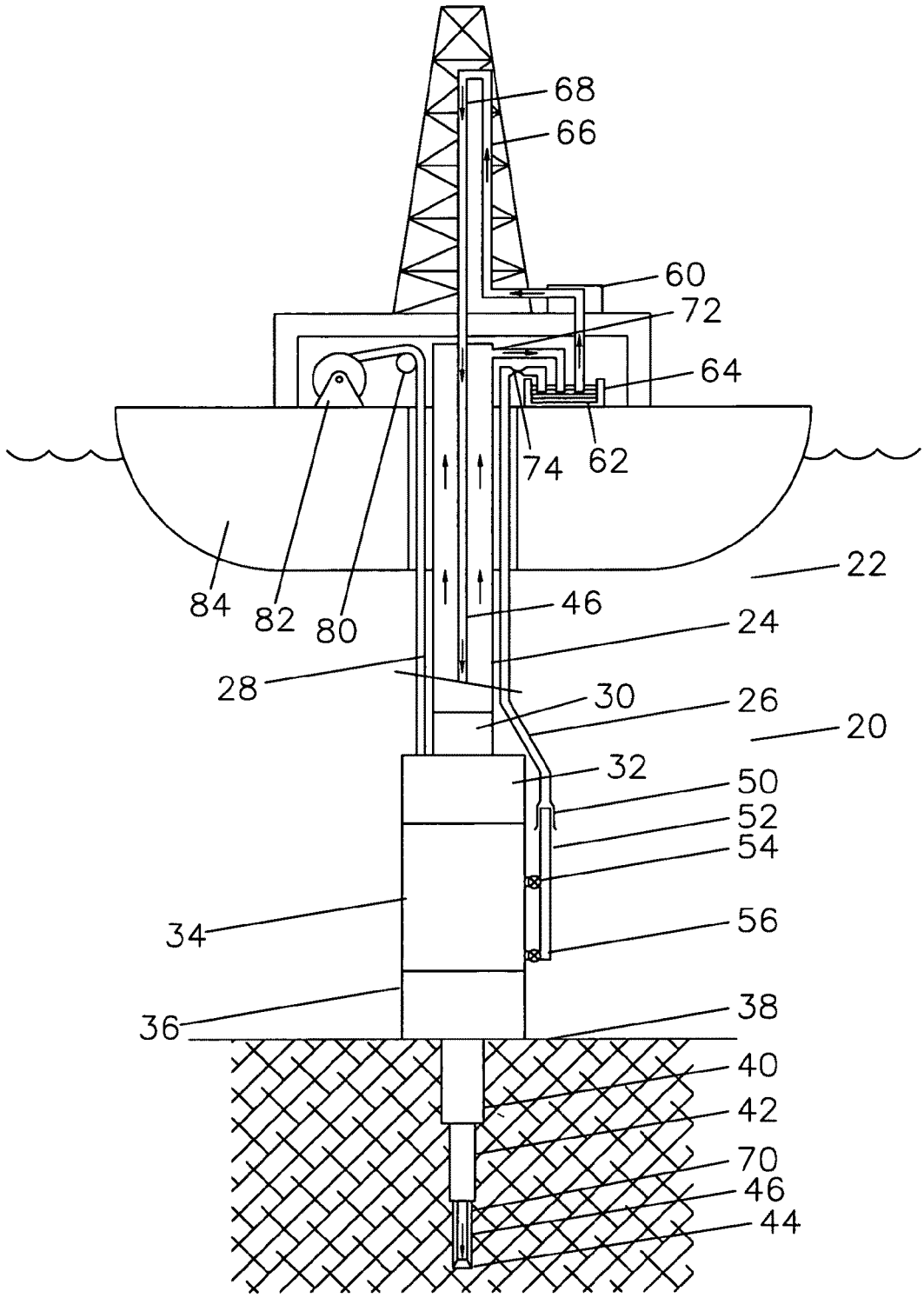
FIG. 1 is a view of a deepwater drilling system using the present invention

Referring now to FIG. 1, a view of a complete system for drilling subsea wells 20 is shown in order to illustrate the utility of the present invention. The drilling riser 22 is shown with a central pipe 24, outside fluid lines 26, and control lines 28.

Below the drilling riser 22 is a flex joint 30, lower marine riser package 32, lower blowout preventer stack 34 and wellhead 36 landed on the seafloor 38.

Below the wellhead 36, it can be seen that a hole was drilled for a first casing string, that string 40 was landed and cemented in place, a hole drilled thru the first string for a second string, the second string 42 cemented in place, and a hole is being drilled for a third casing string by drill bit 44 on drill string 46.

The lower Blowout Preventer stack 22 generally comprises a lower hydraulic connector for connecting to the subsea wellhead system 36, usually 4 or 5 ram style Blowout Preventers, an annular preventer, and an upper mandrel for connection by the connector on the lower marine riser package 32.

Below outside fluid line 26 is a choke and kill (C&K) connector 50 and a pipe 52 which is generally illustrative of a choke or kill line. Pipe 52 goes down to valves 54 and 56 which provide flow to or from the central bore of the blowout preventer stack as may be appropriate from time to time. Typically a kill line will enter the bore of the Blowout Preventers below the lowest ram and has the general function of pumping heavy fluid to the well to overburden the pressure in the bore or to "kill" the pressure. The general implication of this is that the heavier mud will not be circulated, but rather forced into the formations. A choke line will typically enter the well bore above the lowest ram and is generally intended to allow circulation to circulate heavier mud into the well to regain pressure control of the well.

Normal drilling circulation is the mud pumps 60 taking drilling mud 62 from tank 64. The drilling mud will be pumped up a standpipe 66 and down the upper end 68 of the drill pipe 46. It will be pumped down the drill pipe 46, out the drill bit 44, and return up the annular area 70 between the outside of the drill pipe 21 and the bore of the hole being drilled, up the bore of the casing 42, through the subsea wellhead system 36, the lower blowout preventer stack 34, the lower marine riser package 32, up the drilling riser 24, out a bell nipple 72 and back into the mud tank 64.

During situations in which an abnormally high pressure from the formation has entered the well bore, the thin walled drilling riser 24 is typically not able to withstand the pressures involved. Rather than making the wall thickness of the relatively large bore drilling riser thick enough to withstand the pressure, the flow is diverted to a choke line 26. It is more economic to have a relatively thick wall in a small pipe to withstand the higher pressures than to have the proportionately thick wall in the larger riser pipe.

When higher pressures are to be contained, one of the annular or ram Blowout Preventers are closed around the drill pipe and the flow coming up the annular area around the drill pipe is diverted out through choke valve 54 into the pipe 52. The flow passes up through C&K connector 50, up pipe 26 which is attached to the outer diameter of the riser 24, through choking means illustrated at 74, and back into the mud tanks 64.

On the opposite side of the drilling riser 24 is shown a cable or hose 28 coming across a sheave 80 from a reel 82 on the vessel 84. The cable 28 is shown characteristically entering the top of the lower marine riser package. These cables typically carry hydraulic, electrical, multiplex electrical, or fiber optic signals. Typically there are at least two of these systems, which are characteristically painted yellow and blue. As the cables or hoses 28 enter the top of the lower marine riser package 32, they typically enter the top of control pod to deliver their supply or signals. When hydraulic supply is delivered, a series of accumulators are located on the lower marine riser package 32 or the lower Blowout Preventer stack 34 to store hydraulic fluid under pressure until needed.

Figure 2:
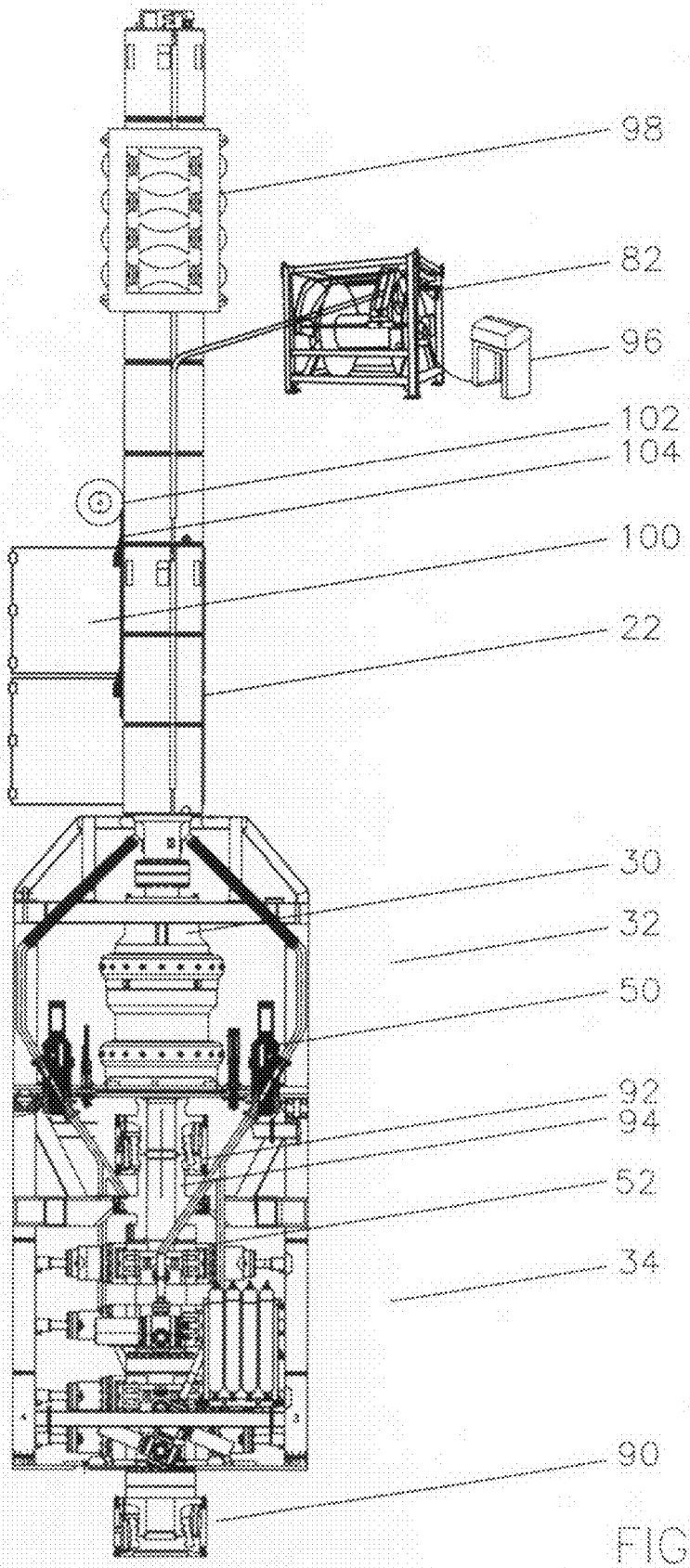
FIG. 2 is a more detailed view of the riser and blowout preventer stack as seen in FIG. 1

Referring now to FIG. 2, a portion of the complete system for drilling subsea wells 20 is shown in greater detail for better clarity. Connector 90 at the bottom is hydraulically operated to provide a connection between the lower blowout preventer stack 34 and the subsea wellhead system 36 as shown in FIG. 1. Hydraulic connector 92 provides a connection between the lower marine riser package 32 and mandrel 94 on the lower blowout preventer stack 34.

Control panel 96 is shown to control the reel 82. Centralizer 98 would be used to control the position of the riser as it is being pulled in currents to prevent it from be pushed into the side of the rotary table by the currents. Fairings 100 can be used to provide a better flow profile and reduce the drag forces on the riser. Winch 102 and chain 104 indicate that the fairings are of a "run through" type which means they are independently supported from the drilling rig, can be run after the riser is in the water, and can remain in place when most of the riser is retrieved, rather than the style which are fixed to individual riser joints.

Figure 3:
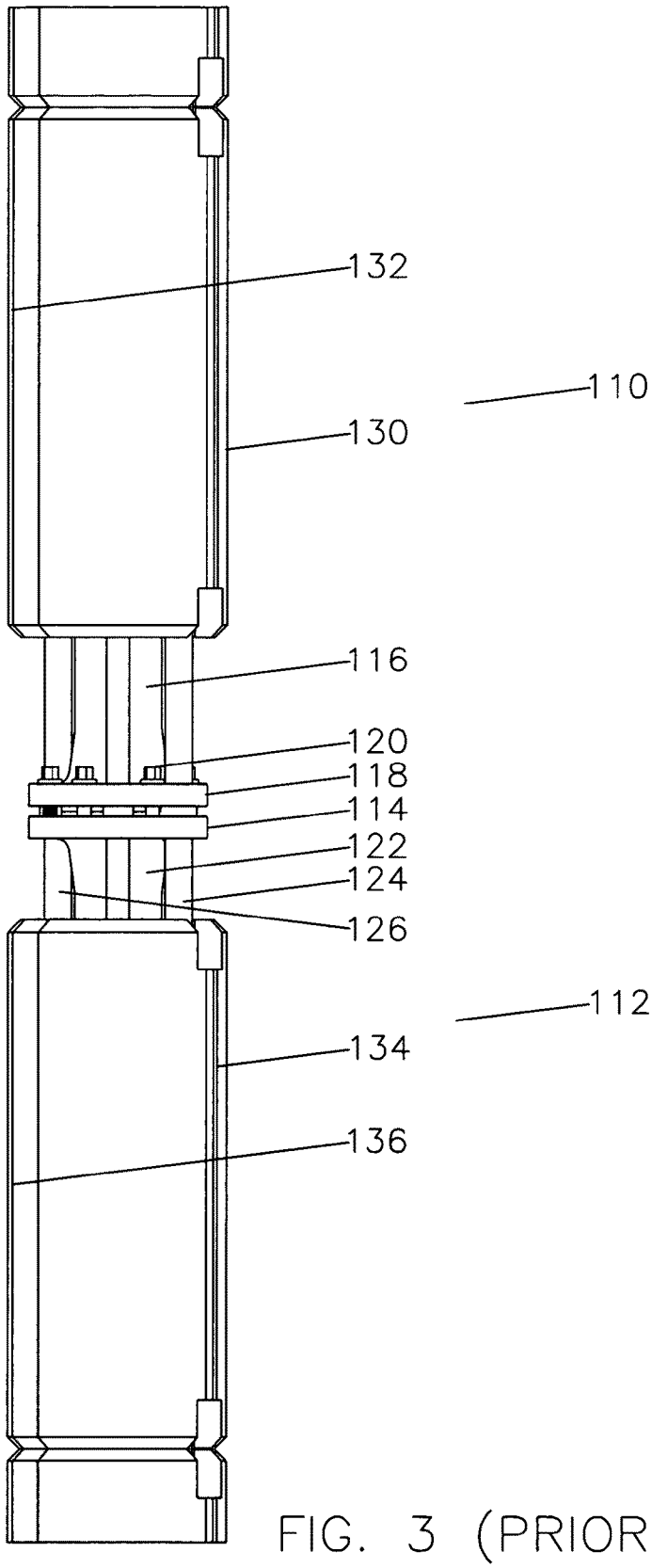
FIG. 3 (PRIOR ART)
FIG. 3 is a view of a portion of a conventional drilling riser.

Referring now to FIG. 3, the connection of two sections of conventional drilling riser 110 is seen. On the upper end of a conventional riser joint 112 an upper flange 114 is seen. It is connected to the flange on the lower end of the adjacent conventional riser joint 116 by lower flange 118 and a multiplicity of bolts 120. The pipe 122 between the upper flange 114 and the lower flange 118 on the same riser joint is typically of a 21" outer diameter, with a varying wall thickness depending primarily on water depth and the resulting tensile loadings. All risers typically will have a choke line 124 and a kill line 126 as outside fluid lines, and may also have hydraulic supply lines and mud flow boost lines. Each of these lines are the typical 70 ft. in length as is the effective length of the conventional drilling riser.

Buoyancy module sections 130 and 132 are shown attached to the lower end of the conventional riser joint 116 and buoyancy modules 134 and 136 are shown attached to the upper end of conventional riser joint 112. The conventional riser joints are 70 ft. long and the flotation modules are conventionally 129" long. Six sections of the 129" long flotation are attached to each riser joint, leaving a gap of 60" or 5 feet in the area of the connection. The space on the upper end of conventional riser joint 112 is used for the insertion of support dogs when running the riser. The larger space on the bottom of the adjacent riser joint 116 is used for the insertion of a hydraulic make-up wrench when running the riser. It is conventional to use 6 support dogs, giving 6 spaces for bolts between the outside fluid lines.

When the drilling riser sees side currents and rollers need to contact the riser assembly to keep it centralized as it is pulled, these long gaps at the connections can be a significant problem. This problem has been addressed in a separate patent application for the Thunderhorse PDQ drilling rig by adding a rotating track, which in one position provides a necessary track for roller and at another rotational orientation provides access to the support shoulders and access for insertion of the wrenches.

Figure 4:
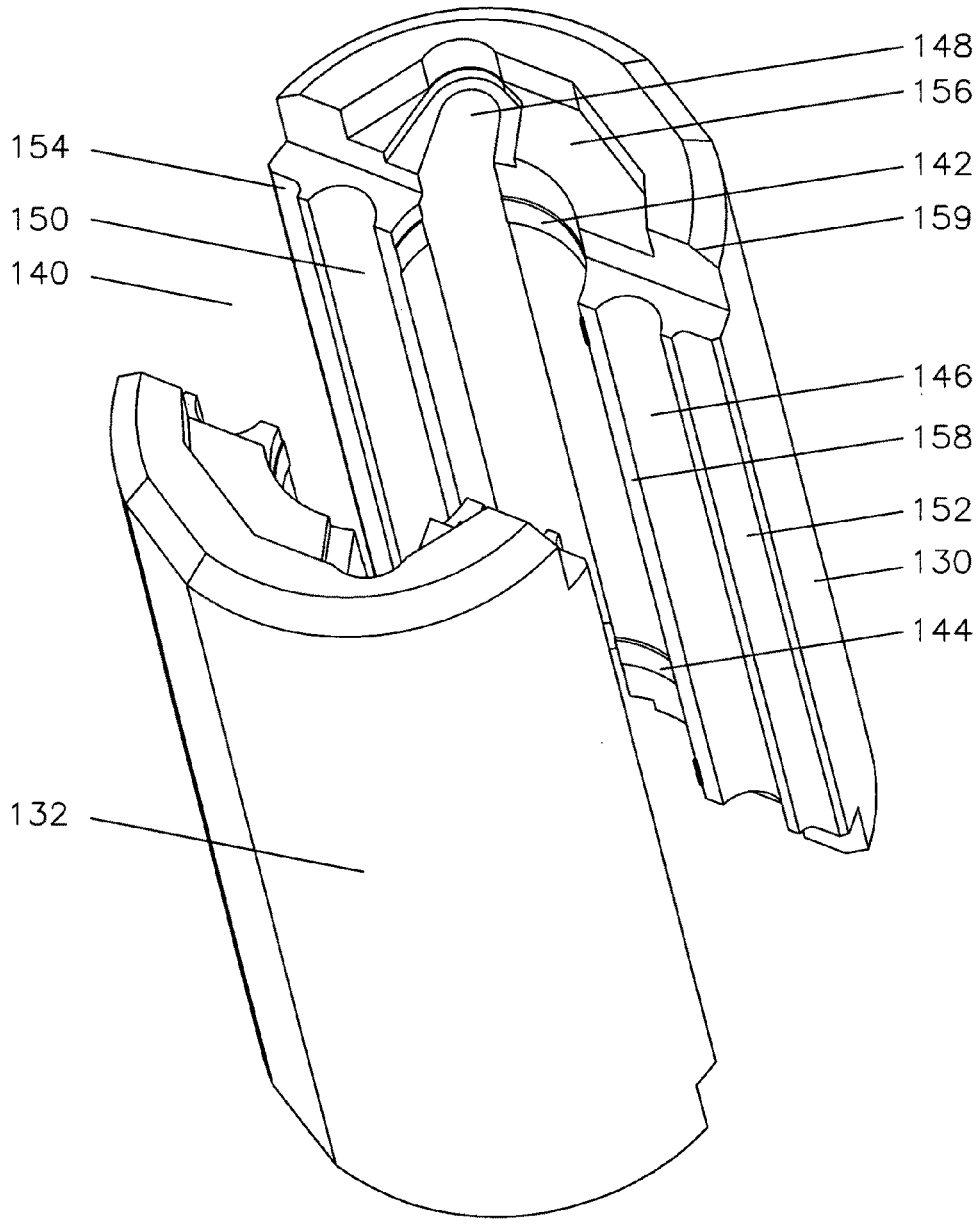
FIG. 4 (PRIOR ART)
FIG. 4 shows a perspective view of a pair of conventional buoyancy modules.

Referring now to FIG. 4, the profile 140 inside the buoyancy half circle module sections is shown. There are bands 142 and 144 molded inside the modules which provide for a known contact with the pipe when the steel pipe is flexed one way or the other way. There are three notches 146, 148, and 150 which allow the flotation modules to be installed onto the assembly when the outside fluid lines are in place. There are notches 152 and 154 which allow the control lines 28 to be stored and clamped in place. There are recesses 156 on each end to allow for clamps which restrain the outside fluid lines 26, and secure the axial position of the buoyancy modules such that they do not block the wrench space or the space for the support dogs.

The weak points in these modules are a load on the center back, causing a tensile failure at 158 and a cantilever or diving board type failure at 159.

Figure 5:
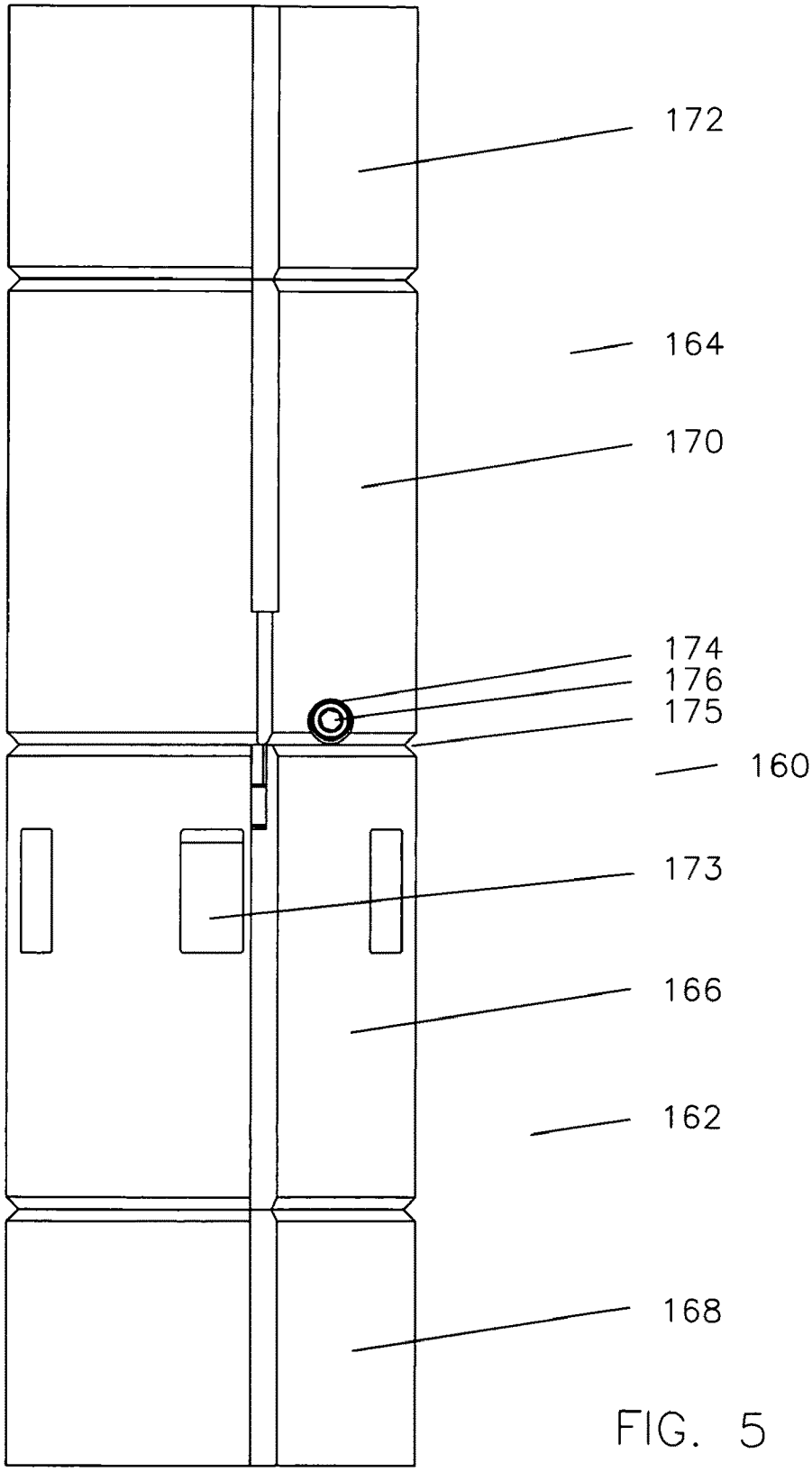
FIG. 5 is a view of a portion of a drilling riser utilizing the buoyancy of this invention.

Referring now to FIG. 5, a similar section of riser 160 of the present invention is shown as was shown in FIG. 3 comprising of a lower riser section 162 and an upper riser section 164. As can be appreciated, when the riser is lowered 70 ft. during the running operations, the upper riser section 164 becomes lower riser section 162 and a fresh riser section becomes upper riser section 164. Lower riser section 162 has buoyancy modules 166 and 168. Upper riser section 164 has buoyancy modules 170 and 172.

All buoyancy module sections 166-172 are a one piece full circle instead of half circle as shown in FIG. 4, but approximately one half as long as the half sections on the conventional drilling riser.

Buoyancy module 166 is specific for the top location of the riser with slots or windows 173 for the insertion of support dogs. The slots or windows 173 (and dogs to be inserted) are tall and narrow rather than flat to minimize circumferential space required for the dog support. This change will allow adequate roller contact in this area without having to have rotatable tracks.

Buoyancy module 164 is specific for the bottom location on each riser joint as hole 174 allows access to a single bolt 176 to make up a novel connection as discussed hereinafter. The nature of these two modules reduces the gap at the connection between the riser joints from 5 feet to a small chamfer 175 the size of the chamfer on all other flotation modules.

Buoyancy modules 168 and 172 are identical and are identical of all intermediate buoyancy modules on the riser joint. Construction of the modules as full circles of one half the length substantially increases the strength of the modules against roller loading failure. Full circle is much stronger than half circle, and half length is much stronger than double length due to shorter bending moment.

Figure 6:
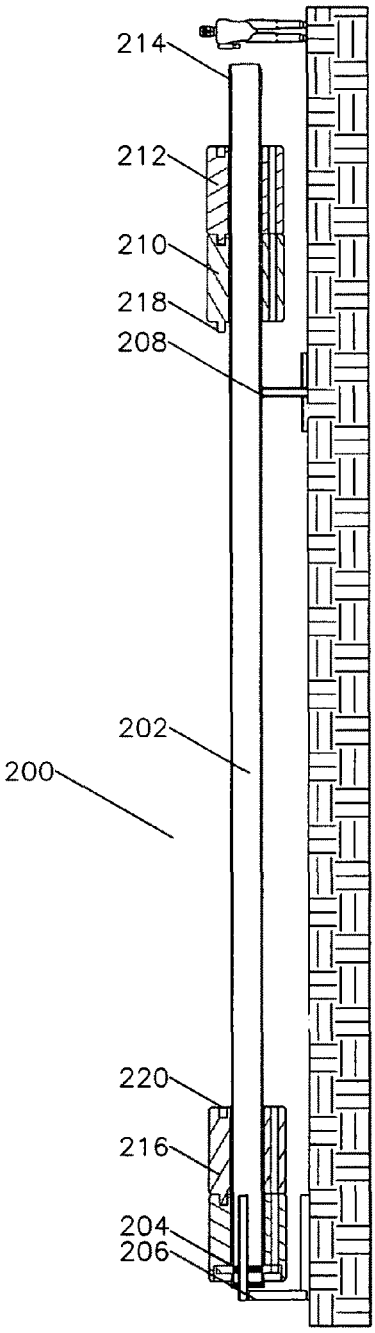
FIG. 6 is a half section of the flotation being installed on a riser joint.

Referring now to FIG. 6, a riser joint 200 is shown with the flotation being installed. Central pipe 202 is shown with an upper flange 204, but no lower flange. Two loading stands 206 and 208 are shown. Circular flotation modules 210 and 212 are shown slipped over the lower end 214 of the riser joint 200 which has no flange. At this time the lower end 214 will be picked up and the buoyancy modules 210 and 212 will be slid down to buoyancy module 216 and tab 218 will engage socket 220 to provide a known orientation between adjacent buoyancy modules. This will be continued until all buoyancy modules are installed and a lower support flange is bolted in place. If will be described in greater detail in FIG. 9.

Figure 7:
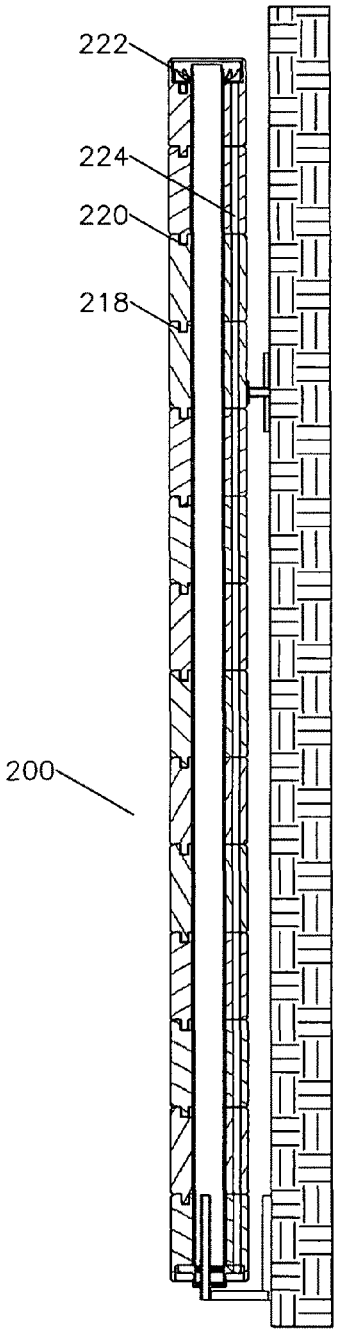
FIG. 7 is a half section of a riser joint with all the flotation loaded.

Referring now to FIG. 7, the riser joint 200 is completely outfitted with buoyancy modules and a lower support flange 222. A complete passageway 224 is shown from the upper end of the riser joint to the lower joint. Passageway 224 represents 5 passageways at 60 degree spacing, with the sixth position having the tabs 218, sockets 220, and bolting as will be seen.

Figure 8:
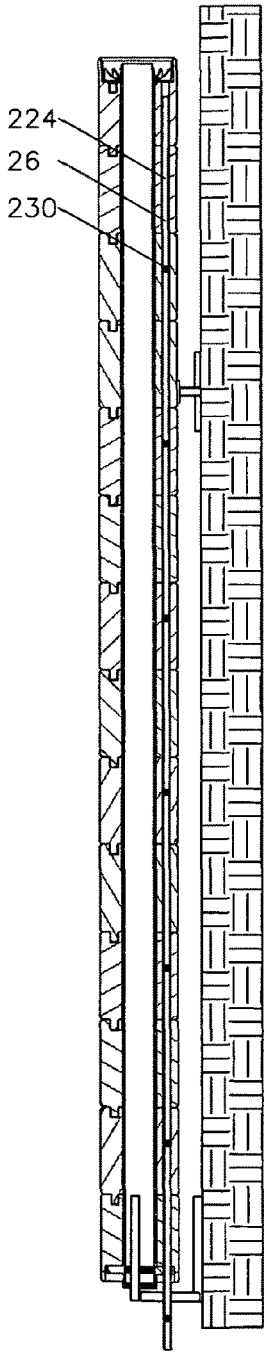
FIG. 8 is a half section showing an outside fluid line being installed in a conduit of the buoyancy.

Referring now to FIG. 8, an outside fluid line 26 such as a choke or kill line is being slid into one of the passageways 224. Stabilizing centralizers 230 are installed onto the outside fluid line 26 to stabilize it within the passageways 224, eliminating the conventional requirement for special clamps which are required to restrain the outside fluid lines.

Figure 9:
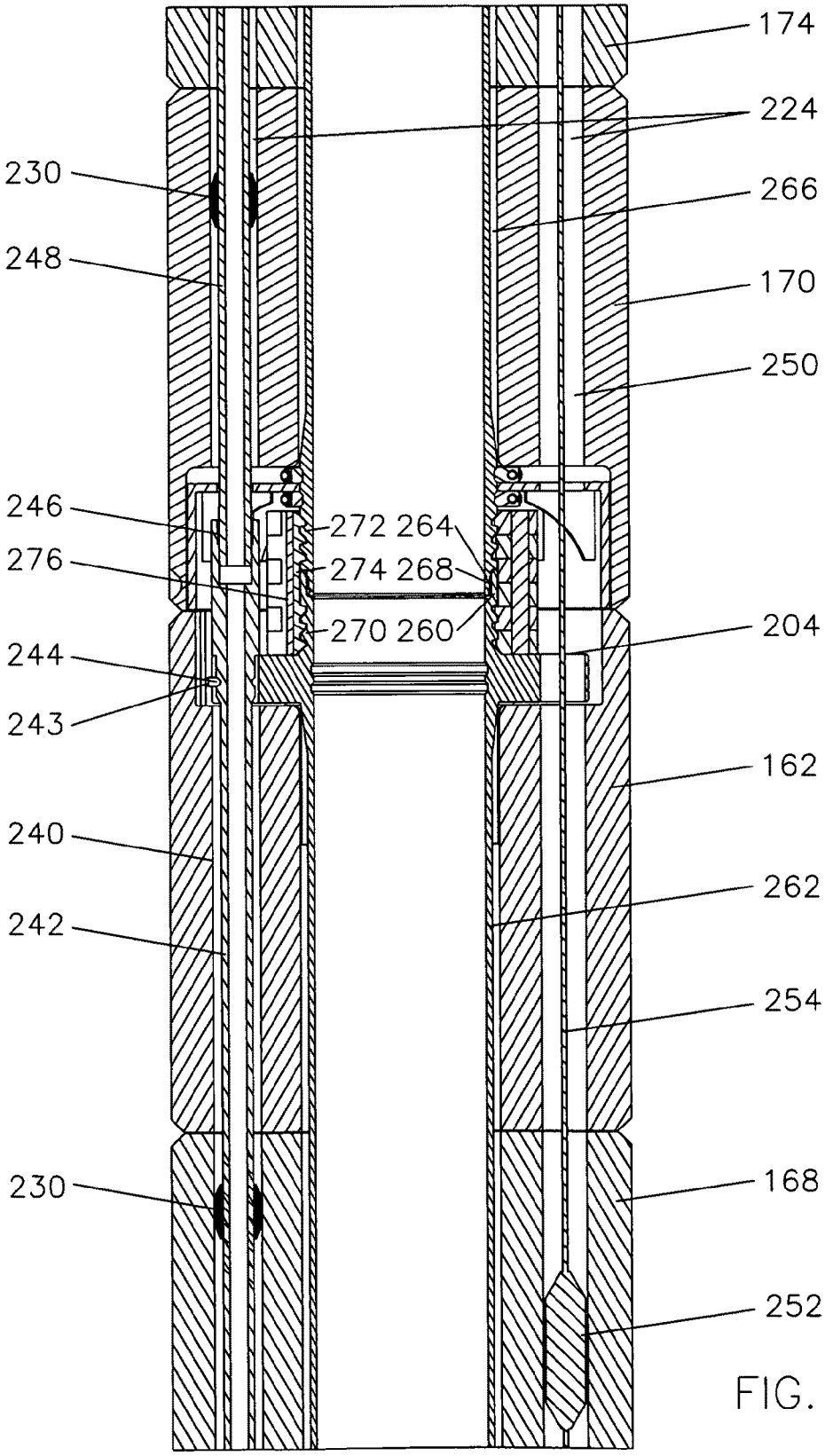
FIG. 9 is a half section of a section of drilling riser using this invention.

Referring now to FIG. 9, a half section is shown of the riser joint of FIG. 5 thru two of the passageways 224. Passageway 240 has outside fluid line 242 installed with a retaining pin 243 installed into a hole in the side of flange 204 to engage groove 244 to fix the outside fluid line 242 in place. Stabilizing centralizers 230 are shown to stabilize fluid line 242 within passageway 240. Seals 246 seal outside fluid line 242 to outside fluid line 248 as will be discussed in more detail in FIG. 14.

Passageway 250 has not received an outside fluid line, but rather is shown as providing a passageway for other services. These services can be to lower instrumentation 252 on a wire 254 such as is shown to measure vortex induced vibration in a riser. Alternately passageway 250 can provide a passageway all the way to the bottom like the vacuum tubes used in banks. A hose can be lowered down to deliver hydraulic fluid. A control connector can be lowered on a control line to provide backup control for a blowout preventer stack in case of controls difficulties. A "Go-Devil" on simple weight can be dropped to actuate a single function in an emergency situation. Basically passageway 250 becomes a utility passageway for anything which needs to be done along or at the bottom of the riser.

A receptacle 260 (See also FIG. 14) at the upper end of lower riser pipe 262 is engaged by nose 264 on the lower end of upper riser pipe 266. Seals 268 seal between receptacle 260 and nose 264. The upper end of lower riser pipe 262 has a clamping profile 270 and the lower end of upper riser pipe 266 has a clamping profile 272. Clamp segments 274 engage the clamping profiles 270 and 272. Tension band 276 urges clamp segments 274 into engagement with clamping profiles 270 and 272 to secure the connection.

Figure 10:
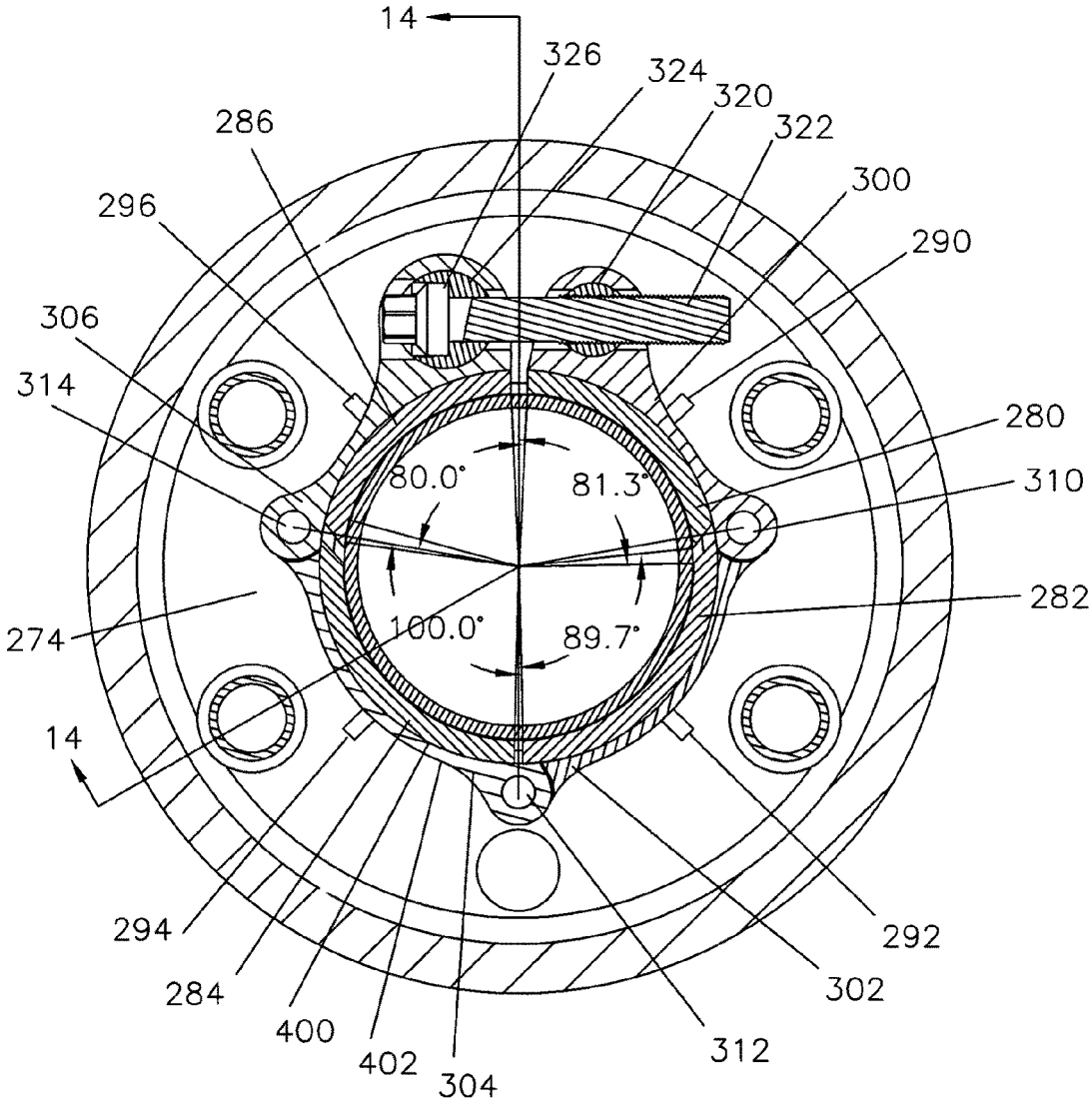
FIG. 10 is a half section through lines "10-10" of FIG. 14.

Referring now to FIG. 10, the clamp segments 274 as shown in FIG. 9 are shown here to be four clamping segments of differing length 280, 282, 284, and 286. Each segment is constrained to move radially into contract with the clamping profiles 270 and 272 as shown in FIG. 9 by keyways 290, 292, 294, and 296, respectively.

The tension band 276 is shown to be made of four section 300, 302. 304, and 306. They are hinged together by hinge pins 310, 312, and 314. At the fourth connection a double pin arrangement is used. A threaded pin 320 is engaged by bolt 322. A non-threaded pin 324 is engaged by shoulder 326 on bolt 322.

Figure 11:
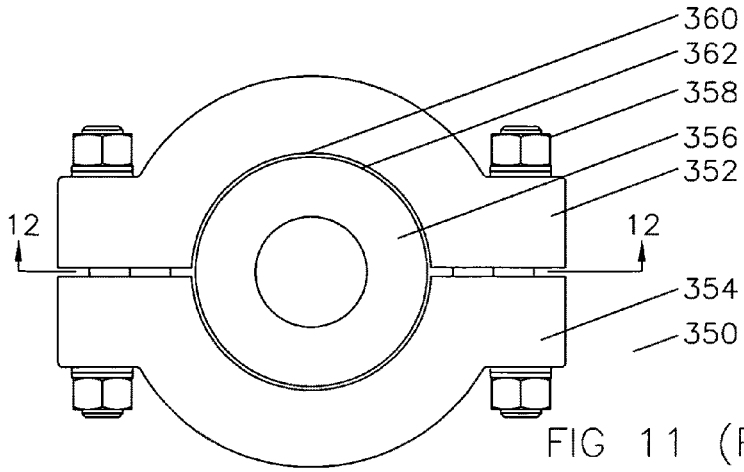
FIG 11 (PRIOR ART)
FIG. 11 is an end view of a conventional clamp.

Referring now to the prior art of FIG. 11, the advantage for the novel design shown in FIG. 10 becomes apparent to those of skill in the art. A two section clamp 350 has clamp halves 352 and 354 tightened on clamp hubs 356 by bolts 358. The inner diameter 360 is intended to be pulled to be concentric with diameter 362 of the clamp hubs 356.

Figure 12:
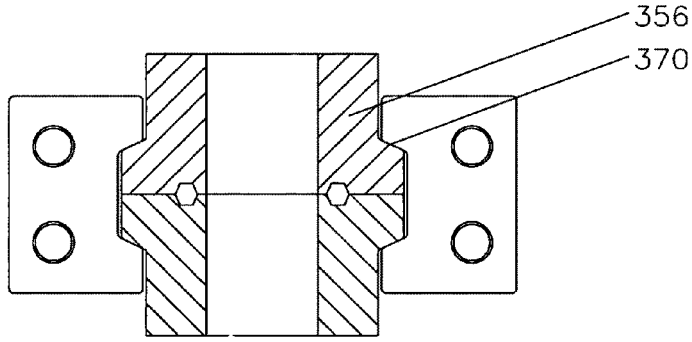
FIG 12 (PRIOR ART)
FIG. 12 is a half section taken along lines "12-12" of FIG. 11.

Referring now to FIG. 12, the engagement of the clamp halves is shown to be on a taper 370 which has approximately a 25 degree slope. It is literally a wedge moving onto the clamp hubs.

Figure 13:
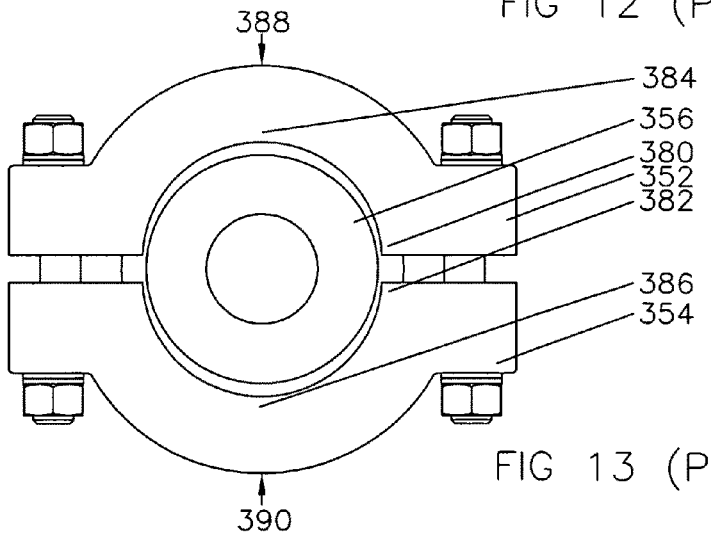
FIG 13 (PRIOR ART)
FIG. 13 is an end view of a conventional clamp similar to view 11, but being partially made up.

Referring now to FIG. 13, a view similar to FIG. 11 is shown, but with the clamps about ¼" from full make-up. Clamp sections 352 and 354 are actually touching clamp hubs 356 only at areas 380 and 382 respectively. Literally no contact is made at areas 384 and 386. The situation is that of a wedge being drug sideways onto the clamp hubs. The result of this type make-up is that the loading in the general areas of 380 and 382 will be high and the loading at 384 and 386 will be low. In some cases the clamp sections of this type are struck with a sledge hammer at locations 388 and 390 to jar the clamp sections into a position of more uniform loading around the circumference.

The irregularity of this make-up can be tolerated on small clamps and clamps which have relatively low loading. On high load clamps such as on deepwater drilling risers, this irregularity of make-up is simply not acceptable.

Referring again to FIG. 10, make-up onto the tapered clamp hubs 270 and 272 of FIG. 9 is constrained to be done radially rather than sliding around the wedge surface. The outer surface 400 of the clamping segments 280, 282, 284, and 286 is a simple cylindrical surface. Outer surface 400 is engaged by simple cylindrical surface 402 of tension band sections 300, 302, 304, and 306. As the tension band is pulled to a smaller diameter by bolt 322, the tension band segments 300, 302, 304, and 306 slide circumferentially around the clamping segments 280, 282, 284, and 284. The load on the clamping segments 282 and 284 will be less than the load on the clamping segments 280 and 286 by the friction on the back of clamping segments 280 and 286. If the coefficient of friction is 0.15, the unit loadings on the clamp segments will be reduced by 15%, rather than the high loses seen by the wedging action of a conventional clamp.

To compensate for this difference in unit loadings, the ratio of the loading area to the ratio of clamping area has been adjusted. In this case the loading area is shown on the left side of the figure and is divided to 80 degrees and 100 degrees. The clamping area is shown on the right hand side of the drawing and is divided to 81.3 degrees and 89.7 degrees. This works out to (100/80)*(81.3/89.7)=1.13 if the sliding area were frictionless. If the coefficient friction was 0.13, the mechanical size changes would closely compensate for this difference. This means that the loads around circumference would be approximately equal rather from varying from high to potentially zero in conventional clamps.

Figure 14:
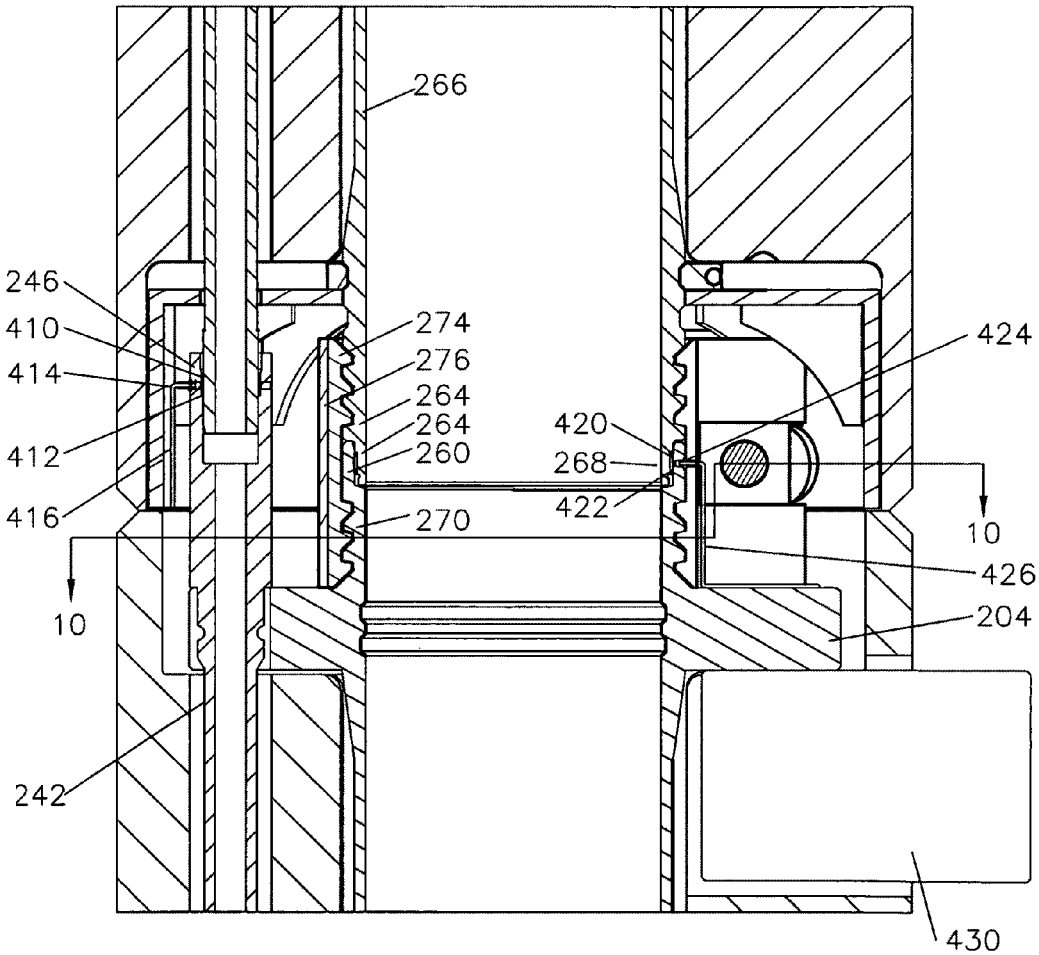
FIG. 14 is a half section of a clamp of this invention taken along lines "14-14" of FIG. 10.

Referring now to FIG. 14, double seals 246 on outside fluid line 242 are shown as seals 410 and 412 with a test port 414 located between seals 410 and 412 and test pressure connecting lines 416. Each of the outside fluid lines will have similar seals, test ports and test pressure connecting lines. Seals 268 on upper riser pipe 266 are shown as seals 420 and 422 with a test port 424 located between seals 420 and 422 and a test pressure connecting line 426.

Flange 204 is shown being supported by dogs 430 which are extended from a riser spider (not shown).

Figure 15:
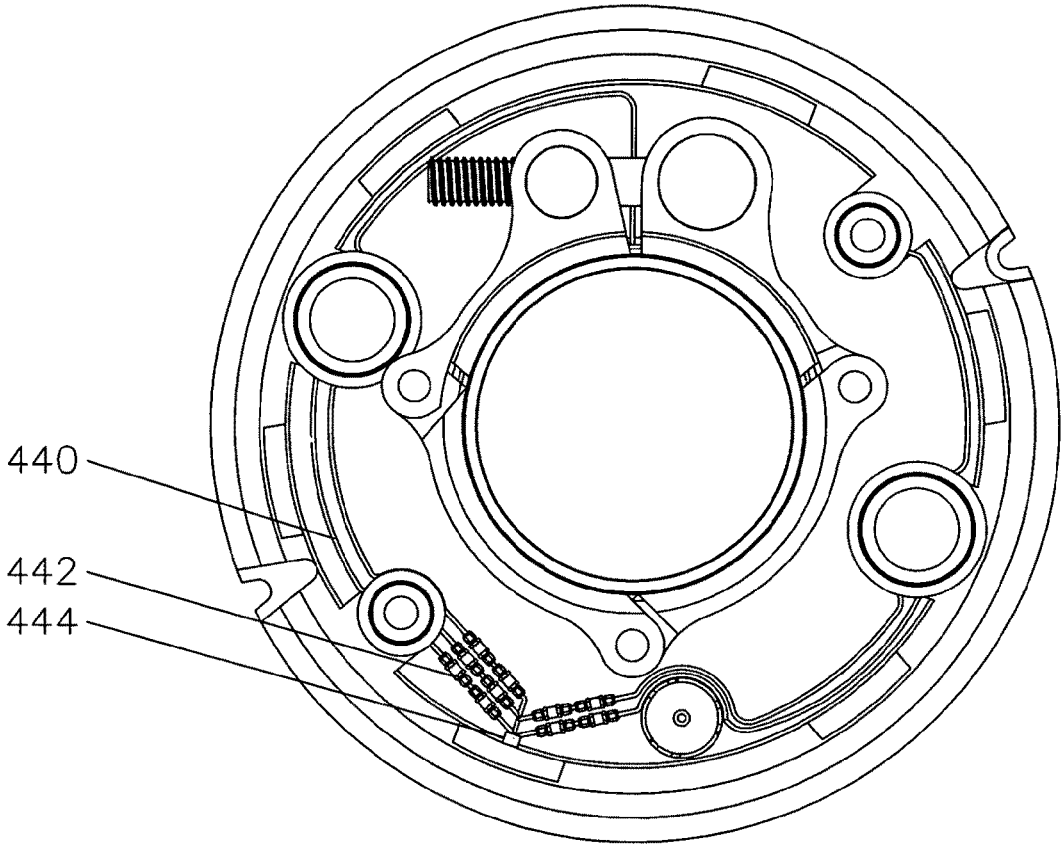
FIG. 15 is an end view of a clamp of this drilling riser showing the test lines.

Referring now to FIG. 15, test pressure lines 440 come from each of the test ports on each of the outside fluid lines and the central pipe connections. Each of the lines go to double check valves 442 and are in turn directed to fitting 444. In this way when a test pressure device is attached to fitting 444, all of the hydraulic lines can be quickly tested to the maximum pressure which can be withstood by any of the lines. As a small area will be exposed to pressure, a higher pressure can be delivered to the test port than the lowest pressure pipe can withstand, likely twice as high as unpressured areas next to the seal area will tend to reinforce the test area. Test pressure fitting 444 does not have a check valve in it such that pressure in any of the test lines 440 is solely sealed by a pair of check valves at 444. If the check valves at 444 fail for any reason, the resultant leak will not be able to enter another set of check valves and back pressure any of the other fittings, but rather simply goes into the sea water.

As make-up of the connection is now controlled by a single bolt, empirical studies can be done to determine the relationship of torque and turn of a properly made up connection. The relationship of torque and turn can be input into a computer and measured each time a connection is made. When this is measured, it can be quickly compared to historical connections and determined if it is a proper make-up. If the make-up curve is too flat, it will likely mean that the connection is failing. If the make-up curve is too steep, it likely means that the bolt is galling. Rather than the 15 minutes required to make up a conventional 6 bolt connection, the single bolt make-up can be likely done within 1 minute and will have a computer generated confirmation of the quality of the make-up.

During the 1 minute to make-up the connection, another employee can attach a test pressure device to the fitting 444 and do a 1 minute test on the various seals. In the one minute, the pressure in the test ports will not stabilize due to temperature cooling. However, they will decline in a predictable fashion and a computer will be able to predict that the seals have quality sealing. If desired, the employee can wait 3 to 5 minutes for confirmation that the pressure is stable, or has gone "flatline".

Figure 16:
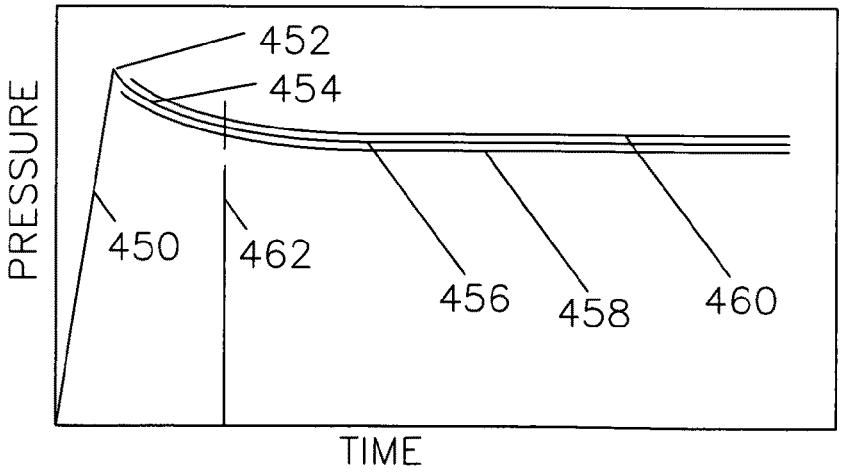
FIG. 16 is a graph illustrating the typical pressure decline curve of a freshly pressure line.

Referring now to FIG. 16, a pressure time graph is shown. Line 450 indicates that the pressure is being rapidly increased from zero to a maximum amount quickly. At point 452 a valve is shut off to block the supply. The liquid and some air in the lines have been quickly pressurized and therefore heated some. As the heat dissipates into the surrounding steel, the pressure drops some until it stabilizes or goes "flatline". Line 454 is what a typical pressure curve looks like as it goes "flatline". At point 456 on this curve it has gone "flatline" after a period of time, i.e. 3 minutes. Lines 458 and 460 show the limits of what the pressure curve is likely to look like during successful testing. It will have some limited variation based on how much liquid is in the lines and how much air is in the lines. Line 462 shows a time during this period, i.e. 1 minute after pressurizing. If curve 458 and 460 have been determined by real life experience and at time 462 the curve is within the limits, there is a high degree of assurance that the test will be a successful test. If this data is fed into a computer, at time 462 the computer can determine that it is likely to be a successful test and indicate that operations can continue. The indication can be by a variety of means such as a printed report or a green light for GO and a red light for STOP.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

That which is claimed is:

1. The method of testing a connection on a drilling riser comprising:

providing double seals on each of a plurality of pipes of said connection of said drilling riser, connecting a connecting line to the area between each of the double seals, connecting each of said connecting lines to an outlet of respective check valves, connecting an inlet of all said check valves to a test fitting, connecting a test line to said test fitting, pressuring said test line to simultaneously test between each of said double seals of said plurality of pipes, closing a valve to lock the fluid pressure in said connecting lines to each of said double seals, digitally recording said fluid pressure trapped in said connecting lines, and establishing acceptable upper and lower pressure limits for a pressure decline after closing said valve.

2. The method of claim 1 further comprising:

comparing said digitally recording of said fluid pressure trapped in said connecting lines with said established upper and lower limits with respect to time for said pressure decline to determine acceptability of said plurality of double seals.

3. The method of claim 2 wherein said acceptability of said plurality of double seals prior to said fluid pressure reaching a steady state value.

4. The method of claim 2 further comprising:

recording the acceptability or rejection of said test of said double seals of said plurality of pipes.

5. The method of claim 2 further comprising:

printing a report of acceptability or rejection of said test of said double seals.

6. A pressure testing configuration to simultaneously test a plurality of pipe connections at a riser connection, comprising:

a plurality of double seals for said plurality of pipe connections wherein each double seal comprises at least two seals spaced apart by less than two feet, a plurality of connection lines to connect to said plurality of double seals at a sealed region exterior to respective pipes for each of said plurality of pipe connections, a plurality of check valves for said plurality of connection lines, a test fitting which connects to each of said plurality of connection lines through said plurality of check valves, a pressure recorder connected to measure and record fluid pressure with respect to time in said plurality of connection lines simultaneously, and a processor which is programmed to compare said fluid pressure with respect to time to upper and lower limits which vary with respect to time and thereby determine whether said plurality of double seals are acceptable.

7. The pressure testing configuration of claim claim 6, whereby said processor is programmed to determine whether said plurality of double seals are acceptable prior to said fluid pressure reaching a steady state value.

8. A method of simultaneously testing a plurality of sealed connections at a joint on a drilling riser, comprising:

simultaneously pressuring up on said plurality of sealed connections;

measuring a pressure decline of said sealed connections with respect to time;

comparing said pressure decline with respect to upper and lower limits which vary with respect to time; and providing a determination whether said plurality of sealed connections are acceptable prior to said pressure decline reaching a steady state value.

9. The method of claim 8, further comprising measuring said pressure decline at a position external to respective pipes for each of said plurality of sealed connections.

10. The method of claim 9, further comprising providing double seals on each of the pipes of said connection of said drilling riser wherein each double seal comprises at least two seals spaced apart from each other by at least two feet.

11. The method of claim 10, further comprising running a plurality of connecting lines to said double seals at said positions which are external to respective pipes, whereby said step of simultaneously pressuring up comprises simultaneously applying pressure to said plurality of connecting lines.

* * * * *